US005797766A

United States Patent [19]

Tanigawa

[11] Patent Number: 5,797,766

[45] Date of Patent: Aug. 25, 1998

[54] LAMP MOUNTING DEVICE

[75] Inventor: Fumiyoshi Tanigawa, Yokkaichi, Japan

[73] Assignee: Sumitomo Wiring Systems, Ltd., Mie, Japan

[21] Appl. No.: 614,056

[22] Filed: Mar. 12, 1996

[30] Foreign Application Priority Data

Mar. 14, 1995 [JP] Japan ..... 7-083165

[51] Int. Cl.[6] ..... H01R 4/24

[52] U.S. Cl. ..... 439/419; 439/56

[58] Field of Search ..... 439/56, 419, 699.2, 439/57, 58

[56] References Cited

U.S. PATENT DOCUMENTS

| | | | |
|---|---|---|---|
| 3,604,919 | 9/1971 | MacPherson | 439/57 |
| 5,389,008 | 2/1995 | Cheng et al. | 439/419 |
| 5,389,010 | 2/1995 | Takano et al. | 439/56 |
| 5,597,329 | 1/1997 | Takano et al. | 439/699.2 |

FOREIGN PATENT DOCUMENTS

| | | |
|---|---|---|
| A-0-404135 | 12/1990 | European Pat. Off. . |
| U-61-38704 | 3/1986 | Japan . |
| A-819009 | 8/1959 | United Kingdom . |

*Primary Examiner*—Gary F. Paumen

*Attorney, Agent, or Firm*—Oliff & Berridge, PLC

[57] ABSTRACT

A bulb mounting portion is formed in each of bulb mounting sockets. Engaging protuberances are formed on a lower end portion of the bulb mounting portion so as to confront each other. On the other hand, a plurality of holding ribs for holding electrical wires and a plurality of pairs of pressure ribs are arranged on a board. A pair of engaging catches are arranged for each bulb mounting socket. For fixing each bulb mounting socket on the board, the engaging catches resiliently engage with the corresponding engaging protuberances.

5 Claims, 4 Drawing Sheets

LAMP MOUNTING DEVICE

BACKGROUND OF THE INVENTION

The invention relates to a lamp mounting device in which lamps are mounted on a board.

A lamp mounting device of this type, which is applied to a tail lamp of an automobile, is known as disclosed in Unexamined Japanese Utility Model Publication Sho-61-38704. FIG. 6 shows this lamp mounting device.

In FIG. 6, pairs of bosses 2 erect at three positions on a board 1. A socket 4 for holding a lamp 3 is screwed between each pair of bosses 2 in such a manner that the socket 4 is inclined. Further, through holes 1*a* are formed at two positions in the board 1, so that electrical wires 5 led out of the sockets 4 extend into the back surface of the board 1 via the through holes 1*a*. Still further, a cover 6 is put on the board 1 so as to conceal the back surface of the board 1. The electrical wires 5 are bundled at one position and extends outside through a through hole 6a formed in the cover 6.

However, in the aforementioned construction one must screw the sockets in order to fix the sockets on the board, which not only is cumbersome, but elevates cost with increasing number of parts such as washers and machine screws.

SUMMARY OF THE INVENTION

The invention has been made in view of the aforementioned circumstances. The object of the invention is, therefore, to provide a lamp mounting device that facilitates the fixing of a socket.

To achieve the above object, the invention is applied to a lamp mounting device that has a board and a socket, the board having electrical wires for supplying power to a lamp laid out thereon, and the socket being attached to the board and allowing the lamp to be mounted thereon. In such lamp mounting device, the board and the socket have engaging portions and engaged portions, both engaging portions and engaged portions engageable with each other; and the socket is fixed on the board by the engaging portions resiliently engaging with the engaged portions.

According to the invention, it is only by resiliently engaging the engaging portions with the engaged portions that the sockets are fixed on the board.

As described in the foregoing, the invention is characterized as requiring merely resilient engagement between the engaging portions and the engaged portions to fix the socket on the board. Therefore, the invention provides the advantage that fixing operation is made extremely easy.

DETAILED DESCRIPTION OF PREFERRED EMBODIMENTS

<First Embodiment>

An embodiment in which a lamp mounting device of the invention is applied to a rear combination lamp (tail lamp) will be described with reference to FIGS. 1 to 3.

Figure 3:
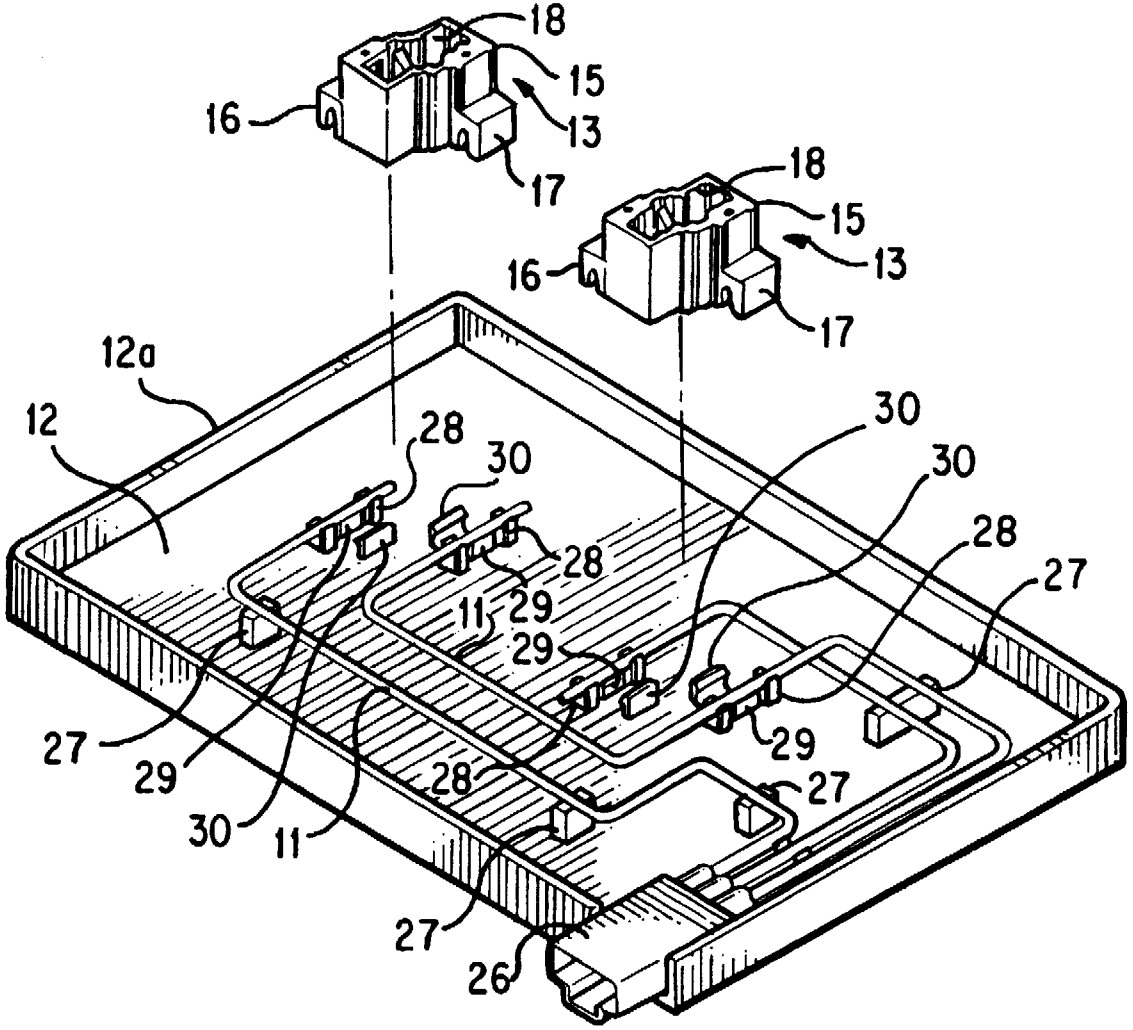
FIG. 3 is an exploded perspective view showing the entire part of the first embodiment.

As shown in FIG. 3, the lamp mounting device in this embodiment includes: a board 12 having electrical wires 11 laid out; and two bulb mounting sockets 13 on the board 12. Each bulb mounting socket 13 is designed so that a bulb 14, which is a lamp (see a wedge base bulb in FIG. 1), can be mounted thereon.

Figure 1:
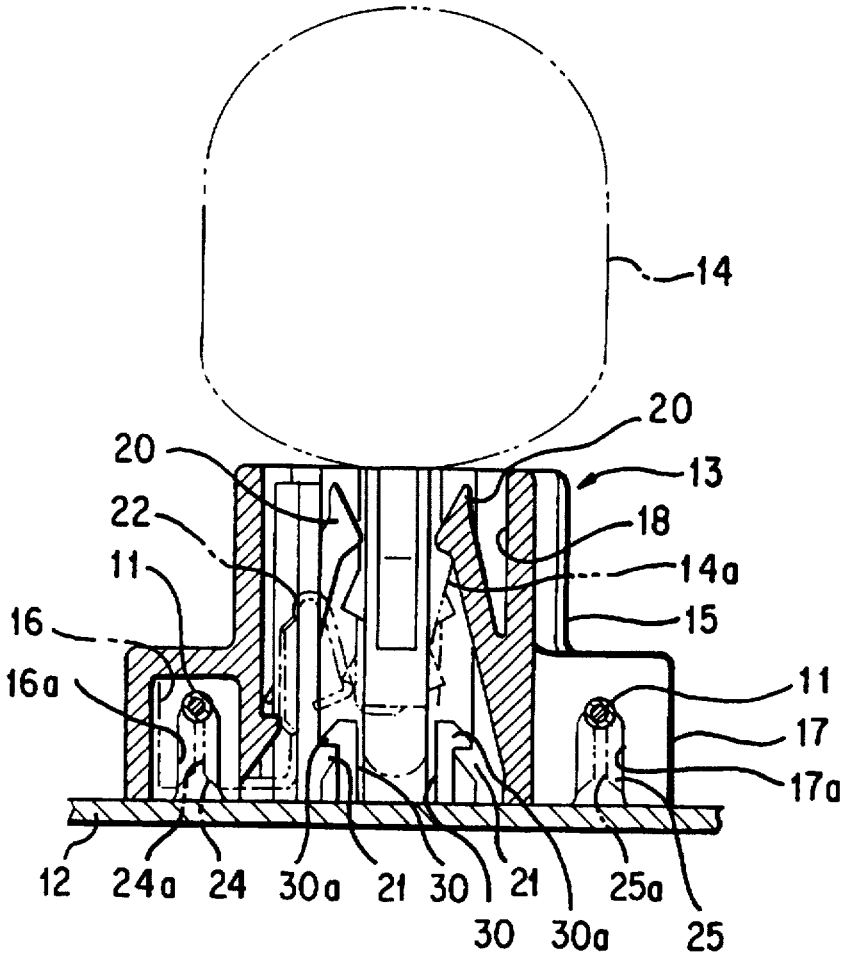
FIG. 1 is a sectional view taken along a line I—I of FIG. 2 to show a fixed state of a first embodiment of the invention.
Figure 2:
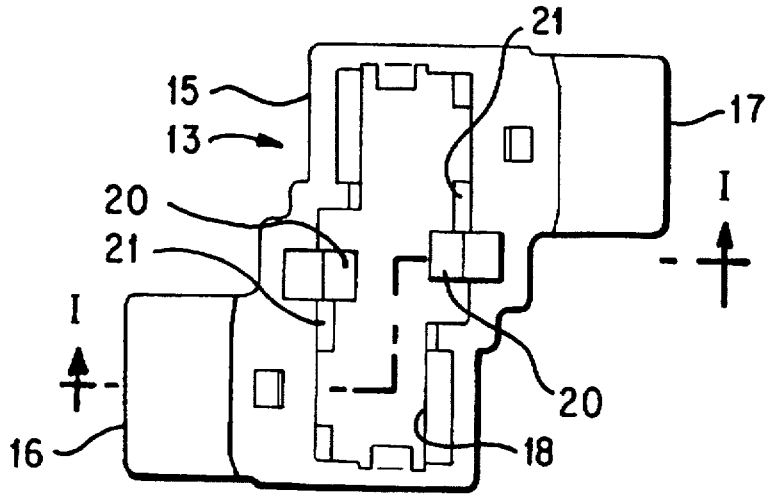
FIG. 2 is a top view showing a bulb mounting socket of the first embodiment.

As shown in FIGS. 1 and 2 each bulb socket 13 has a boxlike socket main body 15. Diametrically confronting lower portions of the socket main body 15 (at the lower left and upper right positions as viewed in FIG. 2) are projected outward to form pressure-engaging portion accommodating chambers 16, 17. Each of the pressure-engaging portion accommodating chambers 16, 17 is formed into a boxlike body whose bottom surface is opened. In addition, notched grooves 16*a*, 17*a*, each having a predetermined height from the opening edge, are formed in both front and rear side surfaces of each of the chambers 16, 17 so as to confront each other. Further, the bottom surface of each of the pressure-engaging portion accommodating chambers 16, 17 is formed so as to be coplanar with the bottom surface of the socket main body 15.

Inside the socket main body 15 is a bulb mounting portion 18 that allows the bulb 14 to be fitted thereinto. Engaging catches 20, 20 are arranged on both left and right side surfaces (both left and right sides as viewed in FIG. 1) of the bulb mounting portion 18. Both engaging catches 20, 20 project upward in such a manner that the distance between the free ends thereof decreases as the free ends project. The engaging catches 20, 20 are designed to engage with engaged portions 14*a*, 14*a* of the bulb 14 that has been fitted into the bulb mounting portion 18. As a result of this construction, the bulb 14 is made unreleasable from the corresponding bulb mounting portion 18. Further, engaging protuberances 21, 21 are provided on both left and right side walls of the bulb mounting portion 18 at a level slightly higher than the bottom end of the side walls. More specifically, the engaging protuberances 21, 21 are provided in the front (the lower side as viewed in FIG. 2) of the engaging catch 20 on the left side wall and in the rear (the upper side as viewed in FIG. 2) of the engaging catch 20 on the right side wall. The engaging protuberances 21 are provided to hold the corresponding bulb mounting socket 13 while engaging with the board 12 side. Each engaging protuberance 21 has the upper end thereof protruding horizontally toward the inside of the bulb mounting portion 18 and has the lower end portion thereof inclined with respect to the inner wall.

Further, a filament side terminal fitting 22 and an earth side terminal fitting (not shown) are assembled onto both left and right side walls of each bulb mounting portion 18. The filament side terminal fitting 22 (indicated by a two dot chain line in FIG. 1) assembled to the left side wall as viewed in FIG. 1 is designed to come in resilient contact with the filament side of the bulb 14 while bent toward the inside of the bulb mounting portion 18 with the upper portion thereof folded back. Further, the lower end portion of the filament side terminal fitting 22 extends into the pressure-engaging portion accommodating chamber 16 that protrudes on the left side surface of the socket main body 15 to form a pressure-engaging portion 24 therein. The pressure-engaging portion 24 is formed into a boxlike body whose bottom surface is opened and is accommodated in the pressure-engaging portion accommodating chamber 16 so as to be in intimate contact with the chamber 16. The pressure-engaging portion 24 also has, on both front and rear side surfaces thereof, pressure blades 24*a* formed at the positions matching the notched grooves 16*a* arranged on both front and rear side surfaces of the pressure-engaging portion accommodating chamber 16. Still further, although not shown, the earth side terminal fitting assembled to the right side wall of the bulb mounting portion 18 has the upper end portion thereof folded back and bent toward the inside of the bulb mounting portion 18 similarly to the filament side terminal fitting 22, and comes in resilient contact with the earth side of the bulb 14. Still further, the lower end portion of the earth side terminal fitting extends into the pressure-engaging portion accommodating chamber 17 that protrudes on the right side surface of the socket main body 15 to form a pressure-engaging portion 25 therein. The pressure-engaging portion 25 is formed into a boxlike body similarly to the pressure-engaging portion 24 of the filament side terminal fitting 22, and has pressure blades 25*a* formed on both front and rear side surfaces thereof.

On the other hand, as shown in FIG. 3, the board 12 is formed into a square tray with the peripheral edge portion of a rectangular bottom plate thereof being erect to form a peripheral edge wall 12*a*. A connector 26 is arranged by cutting one corner of the peripheral edge wall 12*a*. Further, a plurality of holding ribs 27 for holding the wires 11 in place and a plurality of pairs of pressure ribs 28 for holding the wires 11 by pressure are arranged on the upper surface of the board 12. The holding ribs 27 are arranged at four positions as shown in FIG. 3, one of these ribs being capable of holding two wires 11 at once. The pairs of pressure ribs 28 are arranged at four positions so as to correspond to the pressure-engaging portions 24, 25 of the filament side terminal fittings 22 and the earth side terminal fittings that are assembled to the bulb mounting sockets 13, respectively. A wire holding piece 29 is interposed between each pair of pressure ribs 28. The pressure blades 24*a*, 25*a* of the filament side terminal fitting 22 and the earth side terminal fitting are inserted into the gaps between the wire holding pieces 29 and the pairs of pressure ribs 28, so that the wires 11 held by the pressure ribs 28 are forced into the pressure blades 24*a*, 25*a* to thereby establish conduction with the filament side terminal fitting 22 and the earth side terminal fitting, respectively. Further, a pair of engaging catches 30, 30 erect on the board 12 at the positions corresponding to the engaging protuberances 21, 21 of each bulb mounting socket 13. These engaging catches 30 are interposed between the pairs of pressure ribs 28 for the corresponding bulb mounting socket 13. As shown in FIG. 1, the respective engaging catches 30 have catches 30*a* on the sides opposite to the sides facing each other. The height of the catch 30*a* from the board 12 is almost equal to the height of the engaging protuberance 21 from the lower end of the socket main body 15, so that when each bulb mounting socket 13 is put on the board 12 in place, the catches 30*a* of the engaging catches 30 engage with the corresponding engaging protuberances 21.

An operation of this embodiment will be described next. To assemble the lamp mounting device, one causes ends of a plurality of electrical wires 11, whose other ends are connected to the connector 26, to be held by the pressure ribs 28 while holding the wires 11 with the holding ribs 27 along predetermined paths. The wiring operation is thus completed. Then, the filament side terminal fitting 22 and the earth side terminal fitting are inserted to each bulb mounting portion 18 from below the socket main body 15 so as to be assembled to both left and right side walls of the bulb mounting portion. At this point of operation, the pressure portions 24, 25 of the filament side terminal fitting 22 and the earth side terminal fitting are accommodated in intimate contact with the pressure-engaging portion accommodating chambers 16, 17, respectively.

Further, the two bulb mounting sockets 13 with the filament side terminal fittings 22 and the earth side terminal fittings assembled thereto are mounted on the board 12 at the predetermined positions. In order to do so, one puts each bulb mounting socket 13 on the board 12 at the position where the pressure blades 24*a*, 25*a* of the filament side terminal fitting 22 and the earth side terminal fitting are inserted into the gaps between the pairs of pressure ribs 28 and the wire holding pieces 29. As a result, the catches 30*a* of the respective engaging catches 30 are inserted into the bulb mounting portions 18 to engage with the upper ends of the corresponding engaging protuberances 21, which in turn allows the bulb mounting socket 13 to be fixed on the board 12. At the same time, the wires 11 are forced into the corresponding pressure blades 24*a*, 25*a* to thereby establish conduction with the filament side terminal fitting 22 and the earth side terminal fitting, respectively. The lamp mounting device assembling operation is thus completed (see FIG. 1).

Hence, in this embodiment, it is only by engaging the engaging catches 30 with the corresponding engaging protuberances 21 of the socket main body 15 that the bulb mounting socket 13 is to be fixed on the board 12. Therefore, the fixing operation is made easier than the fixing operation involving the tightening of machine screws.

<Second Embodiment>

Figure 4:
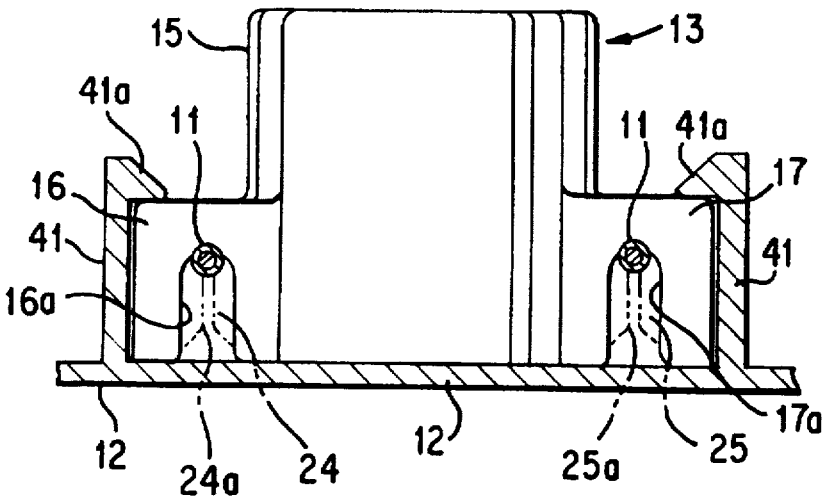
FIG. 4 is a partially sectional view showing a fixed state of a second embodiment of the invention.

A second embodiment in which a lamp mounting device of the invention is applied to a rear combination lamp (tail lamp) of an automobile will hereunder be described with reference to FIGS. 4 and 5.

Unlike in the first embodiment, no engaging protuberances 21 are provided on the bulb mounting portion 18 in the second embodiment. Instead, as shown in FIG. 4, engaging catches 41, 41 on the board 12 are formed so as to engage with the upper surfaces of the pressure-engaging portion accommodating chambers 16, 17 that protrude onto both left and right side surfaces of the socket main body 15.

Figure 5:
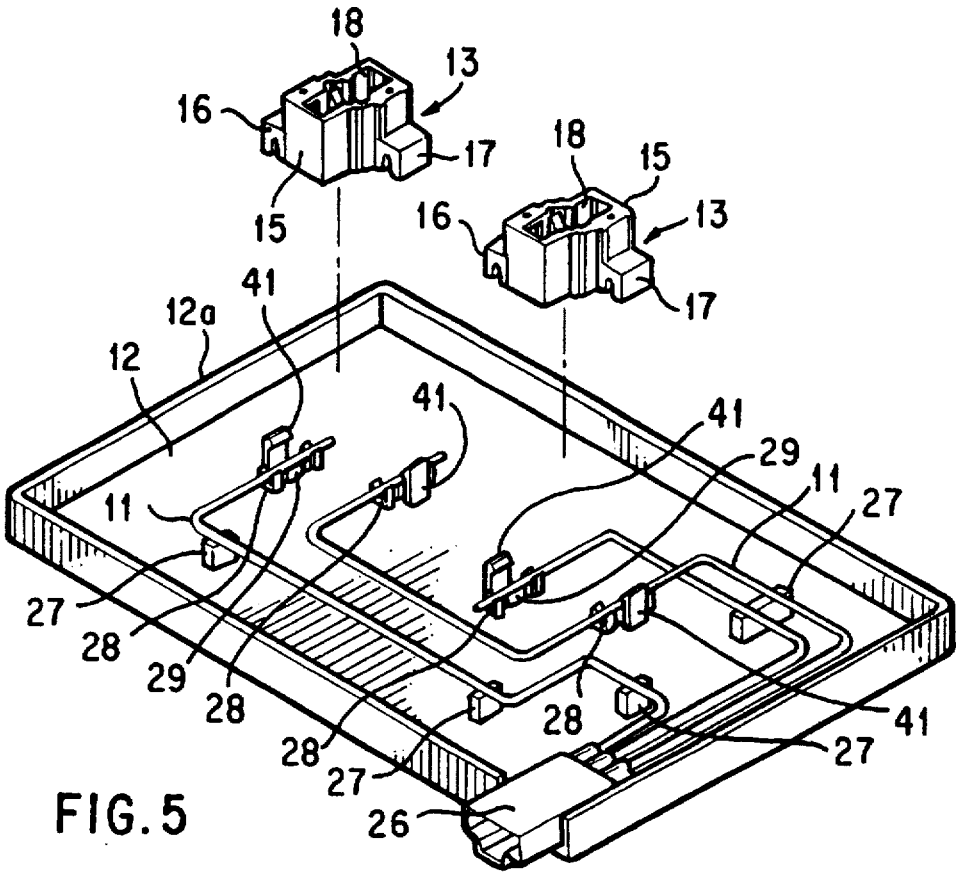
FIG. 5 is an exploded perspective view showing the entire part of the second embodiment.
Figure 6:
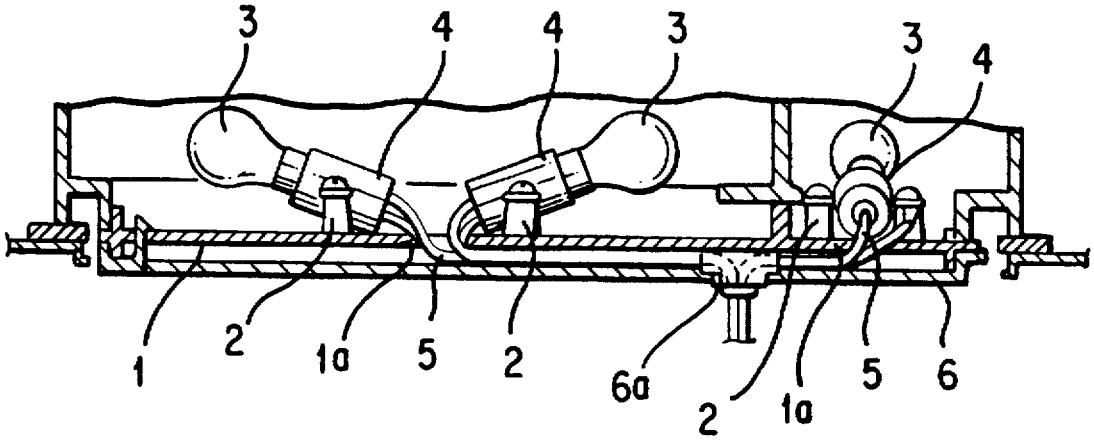
FIG. 6 PRIOR ART
FIG. 6 is a partially sectional view showing a conventional example.

That is, as shown in FIG. 5, the engaging catches 41 confront each other while interposing the corresponding pairs of pressure ribs 28 therebetween, not being interposed between the corresponding pairs of pressure ribs 28. Further, each engaging catch 41 erects slightly higher than the engaging catch 30 of the first embodiment (see FIG. 3). Catches 41*a* are formed on sides of the engaging catches 41 facing each other. The height of the engaging catches 41 is set so that the distance between the board 12 and the catches 41*a* becomes almost equal to the height of the pressure-engaging portion accommodating chambers 16, 17 of the bulb mounting socket 13. It may be noted that the other constructional aspects of the second embodiment are the same as those of the first embodiment and, therefore, that the description of such other constructional aspects will be omitted with the same parts and components denoted as the same reference numerals.

Similarly to the first embodiment, each bulb mounting socket 13 is placed on the board 12 at the position where the pressure blades 24*a*, 25*a* of the filament side terminal fitting 22 and the earth side terminal fitting assembled to the bulb mounting socket 13 are inserted into the gaps between the pairs pressure ribs 28 and the wire holding pieces 29. As a result, the catches 41*a* of the engaging catches 41 engage with the upper surfaces of the corresponding pressure-engaging portion accommodating chambers 16, 17 from outside, which in turn allows the bulb mounting socket 13 to be fixed on the board 12 (see FIG. 4). Further, the wires 11 are forced into the pressure blades 24*a*, 25*a* to thereby establish conduction with the filament side terminal fitting 22 and the earth side terminal fitting, respectively.

The second embodiment is characterized as directly taking advantage of the outer walls of the socket main body 15 as the mating parts without providing the catch means such as engaging protuberances 21 in the socket main body 15 as in the first embodiment. Therefore, the second embodiment contributes to further simplifying the structure for fixing the bulb mounting socket 13 on the board 12. Further, the engaging catches 41 are not concealed by the socket main body 15 after a bulb mounting socket 13 has been fixed on the board 12. Therefore, whether or not the bulb socket 13 is fixed on the board 12 can be checked, which in turn makes the assembling operation more reliable.

It may be noted that the invention is not limited to the aforementioned embodiments. The invention may be embodied while modified in the following way, and such modified embodiment belongs to the technical features of the invention.

Engaging catches are not arranged on the board, but are projected from the bottom surface of the socket main body. Further, engaging holes are formed at predetermined positions in the board. By engaging the engaging catches with the engaging holes, the bulb mounting socket is fixed on the board.

The invention may be embodied while modified in various other ways as long as such embodiments will not depart from the gist of the invention.

What is claimed is:

1. A lamp mounting device comprising:

a board on which power supply wires are laid to supply power to a lamp, said board including a first engagement member;

a socket for the lamp to be mounted to the board, said socket having a second engagement member which is resiliently engageable with said first engagement member and having accommodating chambers for receiving said power supply wires;

a pair of terminal fittings integral with said socket; and a pair of terminals fitted into said terminal fittings, said terminals having end portions extending into said accommodating chambers, said end portions comprising pressure-engaging portions which are brought into contact with said power supply wires when the socket is mounted on the board.

2. A lamp mounting device as claimed in claim 1, wherein said socket further includes an engaging piece to fixedly receive the lamp.

3. A lamp mounting device as claimed in claim 1, wherein said first engagement member includes an engaging catch erecting on the board at a position corresponding to the second engagement member.

4. A lamp mounting device as claimed in claim 1, wherein said first engagement member includes an engaging hole formed on the board at a position corresponding to the second engagement member.

5. A lamp mounting device having a board and a socket, the board having electrical wires laid out thereon for supplying power to a lamp, the socket being attached to the board and allowing the lamp to be mounted therein, wherein the board and the socket have engaging portions and engaged portions, respectively the engaging portions and the engaged portions engageable with each other;

the socket having accommodating chambers with terminal ends disposed therein; and the terminal ends having pressure-engaging portions engaging the electrical wires;

wherein the socket is fixed on the board by the engaging portions resiliently engaging with the engaged portions.

* * * * *